US005540367A

United States Patent [19]

Kauker

[11] Patent Number: 5,540,367

[45] Date of Patent: Jul. 30, 1996

[54] LOOP WATCH

[75] Inventor: William A. Kauker, Huntington Beach, Calif.

[73] Assignee: LOOP, Huntington Beach, Calif.

[21] Appl. No.: 258,514

[22] Filed: Jun. 10, 1994

[51] Int. Cl.[6] ..... A45F 5/00

[52] U.S. Cl. ..... 224/269; 224/180; 224/903; 63/21; 24/3.13

[58] Field of Search ..... 224/170, 903, 224/269, 252, 180, 172, 225, 226, 246; 63/21, 24; 24/3 F, 3 G, 3 J, 3 L

[56] References Cited

U.S. PATENT DOCUMENTS

| | | | |
|---|---|---|---|
| 53,554 | 4/1866 | Badgley | 224/903 |
| 503,480 | 8/1893 | Hopper | 63/21 |
| 843,050 | 2/1907 | Wallerstedt | 63/21 |
| 1,278,866 | 9/1918 | Thompson | 224/903 |
| 1,302,066 | 4/1919 | Mansfield | 224/903 |
| 1,477,680 | 12/1923 | Zetlin | 24/3.13 |
| 1,479,008 | 1/1924 | Powers | 224/269 |
| 1,490,871 | 4/1924 | Wagner | 24/3.13 |
| 1,618,260 | 2/1927 | Armbruster | 24/3.13 |
| 2,075,451 | 3/1937 | Mix | 224/903 |
| 2,236,207 | 3/1941 | Bowder | 24/3.13 |
| 2,411,446 | 11/1946 | Mars | 224/903 |
| 2,455,765 | 12/1948 | Harvey | 24/3 L |
| 2,509,428 | 5/1950 | Greene | 224/252 |
| 2,511,105 | 6/1950 | Fenyvessy | 224/180 |
| 2,527,090 | 10/1950 | Bauman | 63/21 |
| 2,730,277 | 1/1956 | Aszkenas | 224/180 |
| 2,924,364 | 2/1960 | Raguse | 224/903 |
| 3,307,345 | 3/1967 | Cohen | 224/903 |
| 3,552,117 | 1/1971 | Parris | 224/903 |
| 4,272,039 | 6/1981 | Hollingsworth . | |
| 4,951,817 | 8/1990 | Barletta et al. | 224/252 |

FOREIGN PATENT DOCUMENTS

| | | | |
|---|---|---|---|
| 2637469 | 4/1990 | France | 224/164 |

*Primary Examiner*—Henry J. Recla
*Assistant Examiner*—Gregory M. Vidovich
*Attorney, Agent, or Firm*—Wagner & Middlebrook

[57] ABSTRACT

A carrier for watches is disclosed including a loop for engaging the clothing of a wearer and a hanger suspended by the loop. The hanger is dimensioned to support a watch inverted. In one embodiment, the hanger partially encloses and engages the outer surface of the watch case. In a second embodiment, the hanger engages a pin on the six o'clock position pin openings of a wrist watch (with strap removed). In another embodiment, the hanger encloses the watch in a clamshell like fashion. In still another embodiment, a molded hanger of flexible material such as rubber or flexible plastic is formed with a recess to receive a watch.

5 Claims, 3 Drawing Sheets

FIG. 1
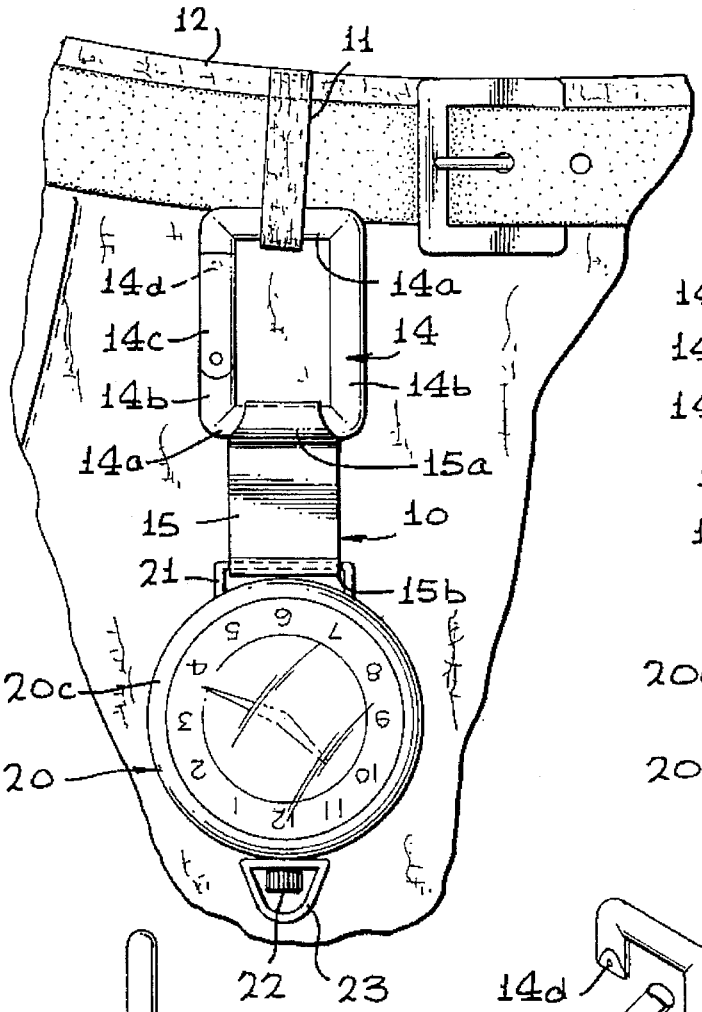
FIG. 2
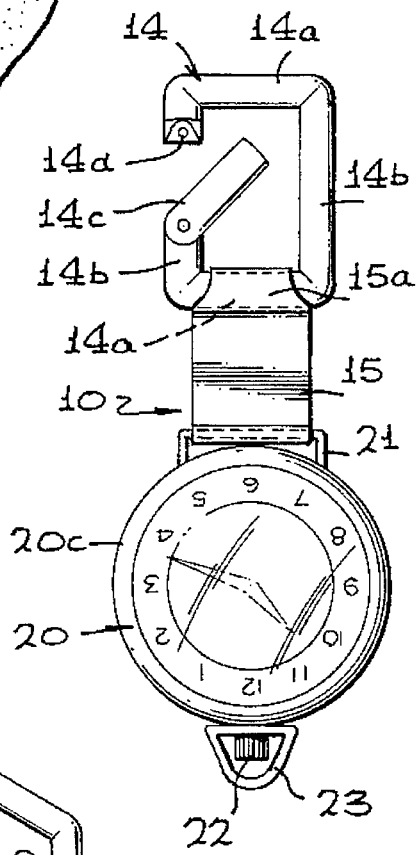
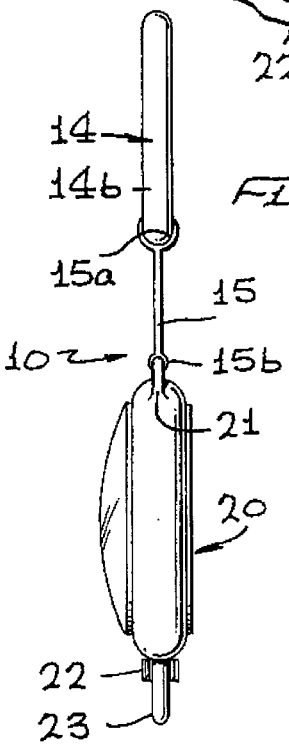
FIG. 3
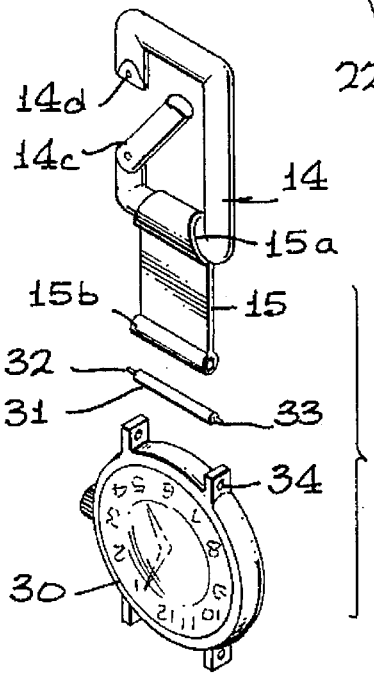
FIG. 4

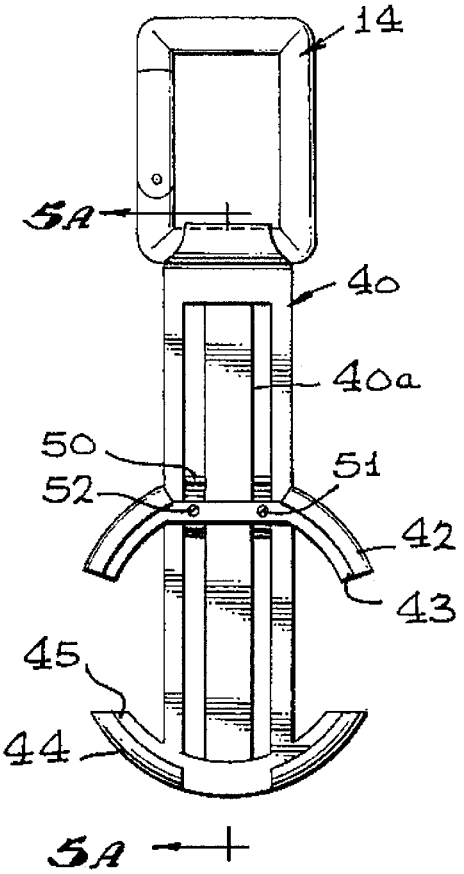
FIG. 5
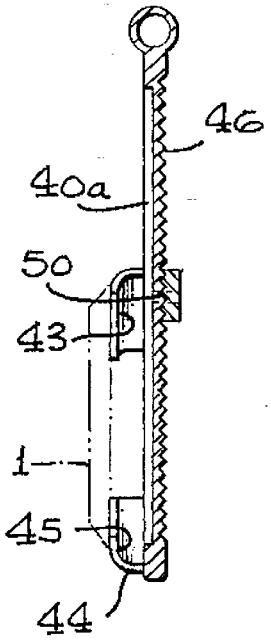
FIG. 5A
FIG. 6
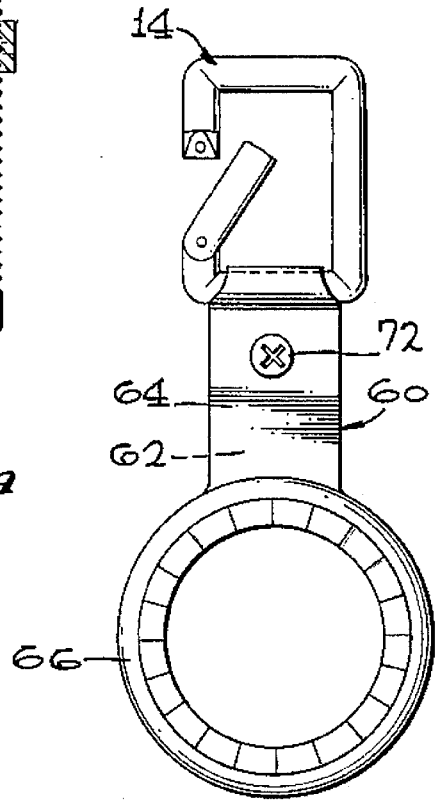
FIG. 7
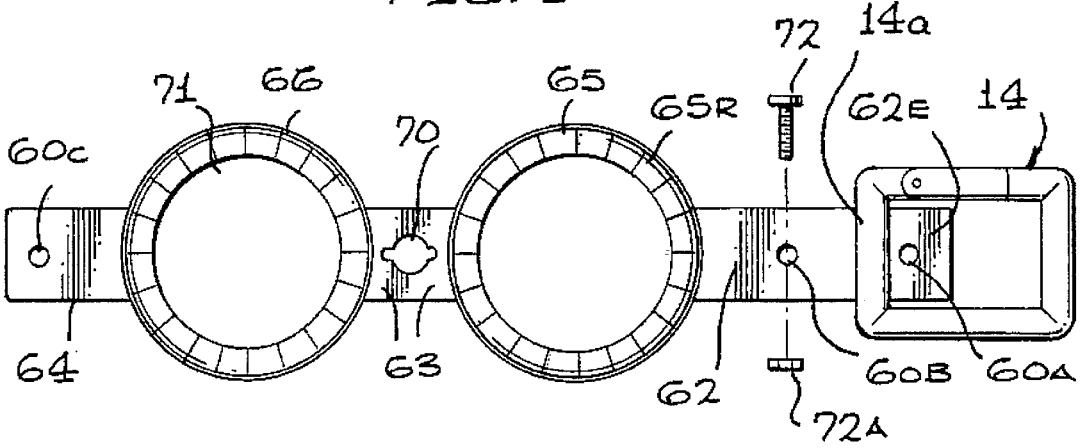

LOOP WATCH

BACKGROUND OF THE INVENTION

For at least a century watches have been carried either on a wrist or in a watch pocket on a chain. Sometimes ladies have carried watches suspended from clips as attractive items of jewelry.

The pocket watch passed out of vogue in the early 20th century and the predominant way of carrying a watch currently is on the wrist. Now wrist watches are worn by ladies just as commonly as men. Expensive identifiable makes of watches costing in the thousands of dollars have become fashion or prestige statements. At the other end of the price spectrum, children commonly wear colorful plastic case and plastic strap watches even before they can tell time.

I have come to the conclusion that another practical and ornamental way to mount and carry watches has been overlooked. It does not obstruct the hands and is readily visible for men having belt loop trousers and for women wearing belts or at least having a waist band on their garment as part of their apparel. Wrist watches have been known to cause injury to the wearer when the band is snagged by machinery or other objects. It is believed that the watch mounting construction described herein does not present comparable hazards.

BRIEF DESCRIPTION OF THE INVENTION

I have designed a series of watches with but a single mounting loop for use particularly on a 12 hour face watch with the loop located at the 6 o'clock hour position, i.e. the bottom of the watch case.

A strap or carrier is designed to engage the mounting loop of the watch case and allow it to pivot. The strap or carrier is dimensioned to encircle a belt loop of trousers or of a belt.

The attachment of this device is not limited to articles of clothing. It is also very functional when attached to other belongings such as backpacks, golf bags and any other attachable article.

The carrier or strap holds the watch in an inverted position so that the wearer need only glance down and the watch is in position to be read without any movement of the wearer's hands. In some cases the wearer may want to tip the watch into full face viewing position. This occurs naturally while the wearer is seated or the wearer may merely momentarily tip the watch upward with either hand.

I have also discovered that existing watches may be used with the carrier of this invention. This is particularly important since many valuable and attractive watches, particularly of the pocket style, languish in dresser drawers. They may be brought out of drawers and worn, used and admired.

Existing watches may be worn with this invention in one of three ways:

1. Existing wrist watches may have their straps removed and the bottom loop of the carrier of this invention made to encircle the normal strap pin adjacent to the 6:00 o'clock or bottom position of the watch. The 12:00 o'clock pin is unused and may be removed, if desired.

2. A pocket style watch may be worn by having a qualified jeweler braze a metal loop to the exterior of the case at the 6:00 o'clock position of the watch and the bottom loop of the carrier snapped over or otherwise secured to the new bottom loop of the pocket style watch.

3. A pocket style watch may also be carried on this invention without modification in either an adjustable clip or a clamshell type carrier.

BRIEF DESCRIPTION OF THE DRAWING

This invention may be more clearly understood from the following detailed description and by reference to the drawings in which:

FIG. 1 is a front elevational view of the watch carrier of this invention worn on the belt loop of a pair of trousers;

FIG. 2 is a front face view of the preferred form of watch carrier and its watch mounting loop;

FIG. 3 is a side elevational view of the carrier of FIG. 1;

FIG. 4 is a perspective view of an alternate form of this invention designed to carry a watch without modification;

FIG. 5 is a front elevational view of an adjustable carrier for watches;

FIG. 5*a* is a side elevational view of the carrier of FIG. 5;

FIG. 6 is a front elevational view of an alternate clamshell form of this invention;

FIG. 7 is a front elevational view of the embodiment of FIG. 6 opened and ready for assembly;

DETAILED DESCRIPTION OF THE INVENTION

Figure 8:
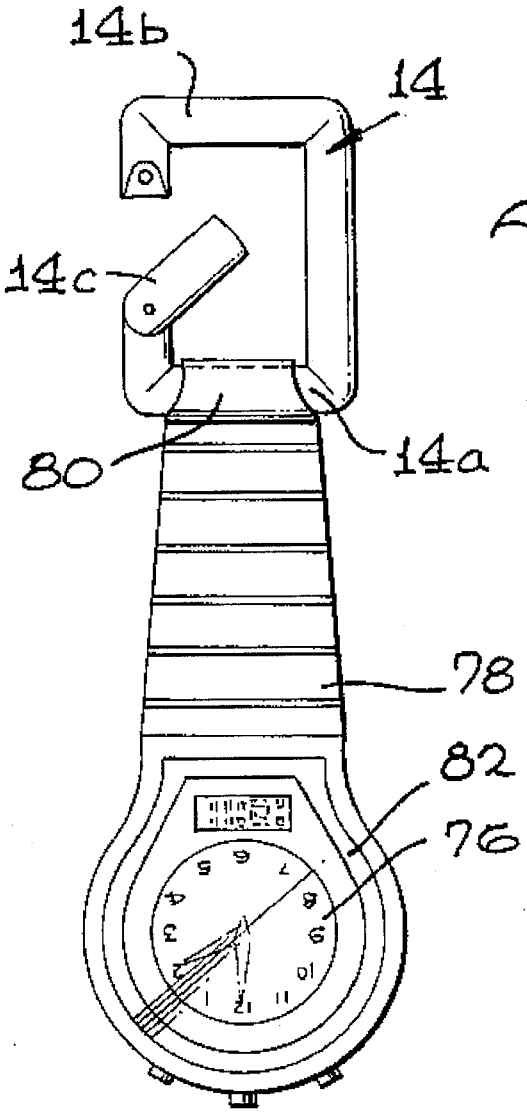
FIG. 8 is a front elevational view of another and the preferred embodiment of this invention.

Now referring to FIGS. 1 and 3, this invention, termed a watch carrier, generally designated 10, is shown worn on a belt loop 11 of the waist band 12 of a pair of trousers or a skirt. The carrier 10 includes an openable-closable elongated hanger 14 carrying a unitary double loop connector strap 15 which is used to support a watch, generally designated 20.

The watch 20, for purposes of description, is a classic design pocket watch having a case 20*c* to which a D-ring 21 has been attached as by internal screws or brazing to the bottom or 6 o'clock position of the case. The watch 20 has a conventional crown 22 and a ring 23. The ring 23 has been used in the past as the traditional place for attachment of a gold or other precious metal chain when the watch was carried in the traditional manner in a gentleman's vest. Sometimes, watch fobs were attached to the ring 23. Employing this invention, the ring 23 is not used. The crown 22 is used in the traditional way for setting of the time and winding the watch's spring movement.

The hanger 14, in its preferred form, is generally rectangular in shape with two straight end or shorter sides 14*a* and the two longer parallel sides 14*b* including the closure 14*c* and the rigid side 14*b*. The hanger 14 is either a conventional carabiner familiar to mountain climbers or a hanger made to present the same general appearance. The lower short side 14*a* encircles the double loop connector 15 which may be produced of sheet metal with an ornamental surface treatment such as silver or gold plating. The open central section of the loop connector 15 is visible for ornamentation or logo use. The connector 15 is unitary and both ends are formed with loops or tubular-openings. The upper tubular opening 15*a* is as shown in the drawing as a larger tube diameter so that it encircles the lower side 14*a* of the hanger 14. The lower tube 15*b* is of appropriate diameter to encircle the D ring 21 secured to the case 20*c* of watch 20. The two straight portions, lower end 14*a* of hanger 14 and D ring 21 act as hinge points for folding the watch upward for viewing when worn as shown in FIG. 1.

In FIG. 2, the hanger 14 is shown with its openable/closable closure, 14*c* shown in an open position. The closure 14*c* is opened to allow the hanger 14 to be attached to the belt loop 11 of FIG. 1. When returned to its aligned position in the longer side 14*b*, the closure 14*c* is held by the presence of detent 14*d* engaging a mating recess in the closure 14*c* in the conventional manner.

Now referring to FIG. 4, the same watch carrier 14 as shown in FIGS. 1–3 is illustrated as used with a conventional wrist watch 30 with its wrist band removed. One of its spring loaded wrist band connector pins 31 remains in place. As shown in FIG. 4, the watch connection is exploded for ease of viewing and understanding. When in use, the pin 31 is inserted through the tube 15*b* in the connector 15 and then the pin ends 32 and 33 are each inserted in their respective pin recesses 34, only one of which is shown in FIG. 4, by depressing the pins 32 and 33 inward. This procedure is well known by anyone changing watch bands. Note, in FIG. 4 that the pin 31 is inserted in the pin retaining, pluralize opening opening 34 associated with the 6 o'clock position of the watch 30 so that the watch hangs inverted. Therefore, any conventional wrist watch having an interchangeable wrist band may be attached to the watch carrier of this invention and worn in a manner such that it can be admired by other persons. The watch is easily accessible by a wearer merely by placing one's hand beneath the connector 15 and lifting the watch 30 into viewing position and releasing it.

For those who have a valuable pocket watch but do not wish to add the ring 21 of FIGS. 1–3 to their watch, the embodiment of FIGS. 5 and 5*a* is particularly useful. The same hanger 14 may be used which operates in the same manner as the embodiments of FIGS. 1–4. An adjustable watch holder 40 includes an upper tube 41 which encircles the end 14*a* of hanger 14 and acts as a hinge similar to the previous embodiments.

The hanger 40 includes an elongated bar 40*a* carrying an adjustable sector shaped clamp member 42 having a recess 43 dimensioned to receive and hold the edge of a pocket styled watch of the type shown in FIGS. 1–3. The lower end of the clamp member 42 includes a second sector shaped clamp 44 with a recess 45 corresponding to the recess 43 of clamp member 42. Both recesses 43 and 45 have generally circular cross sections to match the edge curvature of pocket watches. The hanger 40 may also employ clamp members shaped to receive a rectangular or other shaped watch case.

The clamp member 42 is adjustable on the bar 40*a*, upward to open and allow the insertion of a pocket watch, inverted with the face exposed. The clamp member 42 is then moved downward to engage opposite edges of the case of the watch. The watch is secured in place by locking means.

In this embodiment, two types of locking means are employed. The first involves engaging teeth of a rack 46 on bar 40*a* and mating teeth 50 of clamp member 42 as seen in FIGS. 5 and 5*a*. The second lock is provided by screws 51 and 52 which are loosened to insert a watch and moving clamp 42 into place by ratcheting the teeth 46 and 50 into snug position holding the watch firmly. The segments 42 and 44 have nominal outside diameters of approximately 3" (7.6 cm) to hold conventional pocket watches, or smaller diameters to hold round, octagonal or even rectangular wrist watches. For other shaped wrist watches, the embodiment of FIG. 4 is preferred.

An alternate form of this invention is shown in FIGS. 6 and 7. This embodiment employs a single unitary hanger 60 of plastic or metal having an elongated strap in three sections, a hanger portion 62, a fold portion 63 and a locking portion 64 separated by rear and front watch holding open circular portions 65 and 66, respectively.

The hanger 60 may be molded or stamped in the form shown in FIG. 7 with the watch holding portions 65 and 66 dimensioned to receive a watch case. The watch is, again, mounted inverted with its crown and loop extending through an opening 70 and the face of the watch readable through the opening 71 in the ring shaped holder 66. The hanger 60 and portions 65 and 66 close in clamshell fashion about the watch.

This embodiment provides a secure carrier for watches when a watch is laid in with its back in the recess 65R formed in circular ring 65 and the sections 63, 66 and 64 are folded or bent over the face of the watch with the crown and the ring of the watch extending through opening 70. The end 62E of hanger 60 is bent or folded over the portion 14*a* of ring 14 and the three holes 60A, 60B and 60C are brought into registration and held together by a fastener such as an ornamental head screw 72 and nut 72*a*. Fastener 70 holds the carrier together and secures the watch in place. In various forms of the embodiment of FIGS. 6 and 7, different colors, if molded of plastic, or differences in materials and surface treatment if stamped from metal, e.g. plating, enhance the attractiveness of the hanger 60.

In each of these embodiments, the shapes, color and surface treatment, sizes of the loop 14 and hanger 15, 40 or 60 may be changed to provide a fashion statement while maintaining an attractive convenient and effective watch carrying function.

Figure 9:
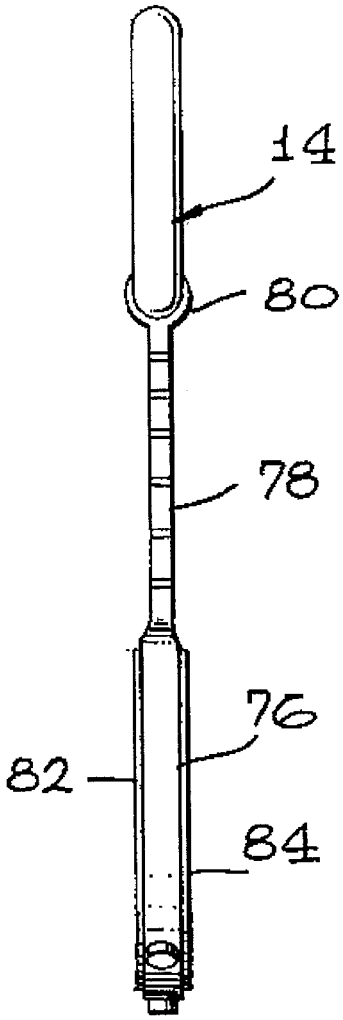
FIG. 9 is a side elevational view of the embodiment of FIG. 8.

FIG. 8 is a front elevational view of another, and preferred embodiment of my invention. In this embodiment, the loop 14 is, or may be, identical to that described above with respect to FIGS. 1 and 2. A watch 76 which may either digital or analog is positioned in a recess in a molded hanger 78 which is flexible and which may be of rubber or flexible plastic. The hanger includes a loop 80 for securing itself to the bottom part 14*a* of loop 14. As shown in FIGS. 8 and 9, a decorative metal plate 82 is secured to the molded hanger 78. Plate 82 may secure watch 76 to the hanger 78 if required, or if hanger 78 is formed with a ridge or lip to secure watch 76 in place, plate 82 may be purely decorative. As will be seen from FIG. 9, there is, or may be, a second plate 84 on the rear side of hanger 78. It also may be purely decorative or may serve to secure watch 76 in hanger 78.

The above described embodiments of the present invention are merely descriptive of its principles and are not to be considered limiting. The scope of the present invention instead shall be determined from the scope of the following claims including their equivalents.

What is claimed is:

1. A carrier for watches comprising:

loop means for attaching a watch to an article of clothing;

said loop means being of a generally elongated rectangular shape and normally closed having a generally laterally extending, substantially straight first loop portion for engaging an article of clothing and for pivotal movement with respect to the article of clothing, a longitudinally extending second loop portion for suspending the watch below the point of attachment to the article of clothing and a laterally extending substantially straight third loop portion parallel to said first loop portion of said loop means wherein said first, second and third portions being coplanar;

watch attachment means including means for suspending said watch attachment means from said loop means by coaxial pivotal engagement with said third loop portion of said loop means;

said laterally extending first and third portions constituting generally parallel pivotal portions for allowing lifting of the watch to a position where the watch face is viewable; and means for securing a watch to said watch attachment means such that the display of the watch is exposed and inverted for viewing by the wearer of the clothing.

2. A watch carrier in accordance with claim 1 wherein said loop means is a carabiner.

3. A watch carrier in accordance with claim 1 wherein said second portion comprising a pair of longitudinal members of substantially the same length wherein each of the longitudinal members being longer than the lengths of each of said laterally extending first and third portions.

4. A watch carrier in accordance with claim 3 wherein at least one of said longitudinal members includes an openable hinge section.

5. A watch carrier in accordance with claim 1 wherein said watch attachment means includes a hangar for holding and securing said watch for attachment to said loop means, said hangar comprising a flexible member.

* * * * *